United States Patent [19]

Cruise

[11] Patent Number: 4,642,961

[45] Date of Patent: Feb. 17, 1987

[54] METHOD AND APPARATUS FOR INSTALLING BOARD-LIKE INSULATING PANELS IN A STANDING SEAM ROOF CONSTRUCTION

[75] Inventor: Robert R. Cruise, Columbus, Nebr.

[73] Assignee: Behlen Mfg. Co., Columbus, Nebr.

[21] Appl. No.: 206,822

[22] Filed: Nov. 14, 1980

[51] Int. Cl.[4] ..... E04B 1/74; E04B 5/00

[52] U.S. Cl. ..... 52/408; 52/404; 52/712

[58] Field of Search ..... 52/404, 406, 407, 712, 52/408, 409; 24/3 D, 3 J, 3 L, 261 R, 261 C, 261 F, DIG. 8, DIG. 10

[56] References Cited

U.S. PATENT DOCUMENTS

| | | | |
|---|---|---|---|
| 2,733,336 | 1/1956 | Clayton | 24/261 R |
| 2,959,896 | 11/1960 | Schneller | 52/712 |
| 3,356,399 | 12/1967 | Young | 52/712 |
| 3,969,863 | 7/1976 | Alderman | 52/407 |
| 4,047,346 | 9/1977 | Alderman | 52/407 |
| 4,058,949 | 11/1977 | Bellem | 52/407 |
| 4,075,806 | 2/1978 | Alderman | 52/407 |
| 4,075,807 | 2/1978 | Alderman | 52/407 |
| 4,117,642 | 10/1978 | Eckert et al. | 52/486 |

*Primary Examiner*—William F. Pate, III
*Assistant Examiner*—Michael Safavi
*Attorney, Agent, or Firm*—Learman & McCulloch

[57] ABSTRACT

A method for installing a board-like block of insulating material in an insulated standing seam roof panel assembly is described, together with a clip which facilitates the installation. The board-like block is installed for the purpose of improving the heat insulating characteristics of the roof in those regions where the primary blanket of insulating material is compressed along the underlying purlins.

8 Claims, 5 Drawing Figures

METHOD AND APPARATUS FOR INSTALLING BOARD-LIKE INSULATING PANELS IN A STANDING SEAM ROOF CONSTRUCTION

BACKGROUND OF THE INVENTION

Because standing seam roof constructions utilize sheet metal roof panels, it is frequently necessary to install a relatively thick blanket of insulating material immediately beneath the sheet metal roof panels to minimize heat transfer through the roof. In a typical installation sequence, the blanket of insulating material is placed in position upon the purlins of the roof framework, a series of bracket-like roof panel mounting clips are mounted on top of the blanket along a purlin by self-tapping screws which pass through the blanket to secure the clips to the purlin, and one standing seam edge of a sheet metal roof panel is then placed over and secured to the panel mounting clips. A second set of panel clips is then installed adjacent the opposite standing seam edge of the roof panel, similarly secured to the underlying purlins, and the next roof panel is installed in the last mounted set of clips.

Because the roof panels involved are relatively long and narrow, a typical standard panel having a length of twenty feet and a width of two feet, the panel mounting clips on a given purlin are spaced from each other by a distance equal to the panel width—that is two feet—and each installed panel clip compresses the insulating blanket between the clip and purlin. Because the clips are spaced from each other by only a relatively short distance along the purlin, the insulating blanket, in its finally installed condition, has a region of substantially reduced thickness along and adjacent to each roof purlin. Because the effectiveness of the heat insulating blanket is dependent upon its thickness, these regions in which the blanket is compressed along each purlin offer substantially less resistance to the flow of heat through the roof. This effect may be observed on heated buildings after a light snow fall—the locations of the purlins can be readily identified by regions of melted snow while the remaining roof remains snow covered.

It has been proposed to minimize this effect by installing, on top of the insulation blanket, a board-like block of insulating material, such as styrofoam, to provide an increased thickness of insulating material over the region which is compressed along and adjacent to the purlins (See, for example, U.S. Pat. No. 4,058,949). However, the installation of such blocks is complicated by the fact that such blocks must be located in position before the overlying roof panel is installed, and the installation of the panel frequently disturbs the location of the blocks. This problem arises because the roof panel, which is installed with its long dimension normal to the longitudinal extent of the purlins, will extend across several purlins, thus necessitating laying several individual blocks of insulating material, one over each purlin, before the roof panel is moved into position. Once the panel is moved into or close to its finally installed position, the insulating blocks are concealed beneath the panel. It is usually necessary to shift the roof panel being installed longitudinally into the desired side-by-side alignment with the previously installed roof panel. It is in the placing of the roof panel that the location of the insulating blocks can be disturbed. Once the roof panel is in its final position, the panel presses the block against the top of the insulating blanket so that the block does not move, but during the placement of the roof panels, this action may displace the insulating block from its intended position.

The present invention is especially directed to a method and an apparatus for overcoming the problem discussed above by employing a simple wire clip which can be mounted upon one end of the insulating block and engaged with the panel mounting clip or bracket to prevent displacement of that end of the insulating block during the subsequent installation of a roof panel.

SUMMARY OF THE INVENTION

In accordance with the present invention, the panel mounting clips, which include a vertical web, are formed with a pair of relatively small openings through the vertical web. An insulation board retaining clip is formed from a length of stiff resilient wire or rod-like material with two spaced parallel arms, one end of each arm being insertable through the openings in the panel mounting clip. The arms are oriented to extend longitudinally of the insulating board, and at the inner ends of the arms, the wire is bent at right angles to the arm and then shaped to transversely extend around and grip the insulating board. The wire clip is installed in the field by the roofer on one end of the board, the projecting arms of the clip are then inserted into the two holes in the bracket which are positioned so that the upward force of the compressed insulation exerted on the board tends to cause the arms to bind in the holes, and the roof panel is then installed on the bracket.

Other objects and features of the invention will become apparent by reference to the following specification and to the drawings.

IN THE DRAWINGS

Figure 1:
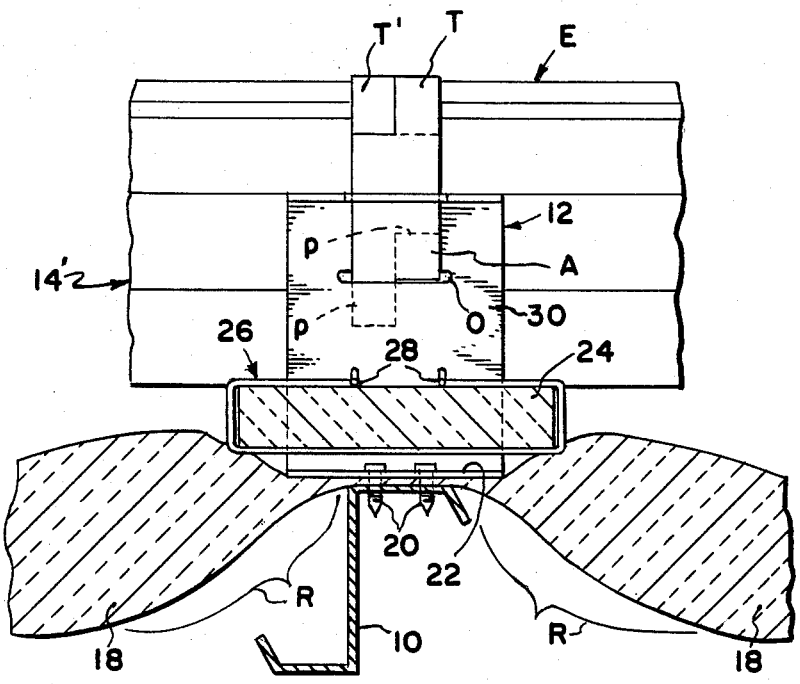
FIG. 1 is a cross-sectional view of a roof construction embodying the present invention taken in a plane normal to a purlin.
Figure 5:
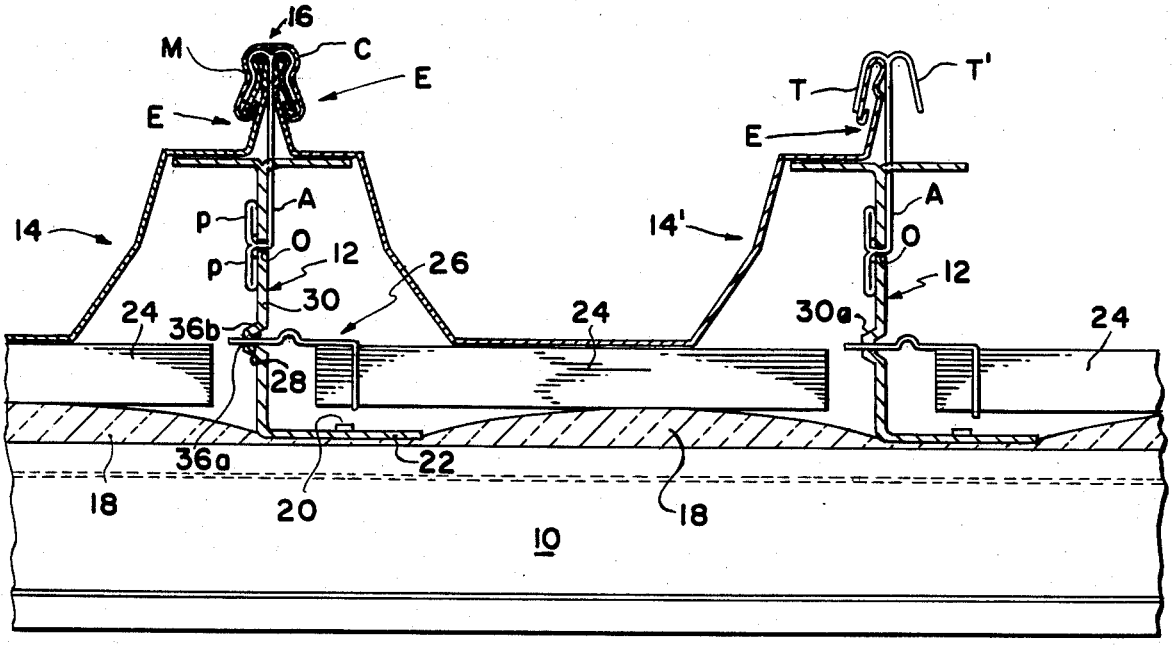
FIG. 5 is a cross-sectional view through a roof construction embodying the present invention taken in a plane parallel to the longitudinal extent of a purlin.

FIGS. 1 and 5 of the drawings are cross-sectional views, taken at right angles to each other, showing the general arrangement of a roof panel assembly embodying the present invention. This particular roof construction, apart from those details relating to the installation of the heat insulating, is described in detail in a commonly owned co-pending application in the name of Harold G. Simpson, Ser. No. 183,717, filed Sept. 3, 1980, which is incorporated herein by reference and to which further reference may be had as to details of the roof panels, panel mounting clip or bracket and the roof panel assembly techniques.

In FIGS. 1 and 5, a purlin 10, which constitutes a fixed part of the roof framework, fixedly supports a panel mounting clip or bracket designated generally 12 which in turn supports the standing seam edges E of the individual roof panels designated generally 14 of a standing seam roof.

Referring to FIG. 5, at the left-hand side of this figure two roof panels 14 and 14' are shown in their final assembled position with a completed standing seam joint joining the two panels 14, 14' to each other as at 16 along their opposed longitudinal side edges E. Standing seam edges with the mastic M seal described in the aforementioned application are united by a cap strip C deformed to lock them together by the seamer in the manner indicated. At the right-hand side of FIG. 5, a panel mounting clip or bracket 12 is operatively engaged with the longitudinal side edge E of panel 14' and the bracket has been fixedly installed upon purlin 10 in readiness for the installation of a subsequent roof panel to form a seam of the configuration of the completed seam 16 at the left-hand side of FIG. 5. The clip or bracket 12 as in the aforementioned application has metal tie strips or clip attachments A with lower retaining parts p extending through openings O provided in the clips 12. At their upper ends the tie strips A have oppositely bent tabs T and T' which hook over the opposed standing seam edges of each standing seam joint.

Referring now to FIG. 1, it is seen that a blanket of insulating material 18 is located in overlying relationship with purlin 10. The panel mounting clip or bracket 12 clamps this blanket 18 between itself and the top of purlin 10 in that the mounting screws 20 which secure bracket 12 to purlin 10 pass downwardly through a horizontal flange 22 (FIG. 1) of bracket 12, then through blanket 18, and then through the upper flange of purlin 10 to fixedly mount bracket 12 in place on the purlin. The clamping of insulating blanket 18 between bracket 12 and the purlin not only tightly compresses the blanket between the bracket and purlin, but also creates at each side of the purlin a region of the blanket designated generally at R which has a thickness which is substantially less than the normal thickness of the blanket. This region of reduced thickness is most apparent on the underside of blanket 18 because the blanket normally tends to sag downwardly somewhat in its extent between adjacent purlins (FIG. 1).

As previously described, the width of roof panels 14, 14' is relatively narrow, two feet being a typical dimension. Thus, as can be best appreciated from FIG. 5, panel mounting brackets 12 are mounted upon each purlin 10 of the roof framework at two-foot intervals, hence the compressed or reduced thickness regions R of the insulating blanket 18 are of substantially uniform thinness substantially over the entire length of the purlin.

In order to reduce the heat loss potential occasioned by this region of reduced thickness of the insulating blanket 18, a board-like thermal block of insulating material, such as styrafoam, designated 24, is placed upon the upper side of blanket 18 to overlie the purlin 10 and the adjacent regions of reduced thickness of blanket 18.

The board-like blocks 24, as indicated in FIG. 5, are placed upon the top of insulating blanket 18 before the overlying roof panel is installed. The blocks 24 are of relatively light weight, they are placed on the upper surface of the insulating blanket 18 with their long dimensions normal to the slope of the roof, the roof panel to be installed will normally overlie several blocks 24, all of which must be positioned before the panel is installed, and the panel being installed, as it is moved into its final position, largely conceals the blocks 24. All of these factors can contribute to finding the blocks 24 displaced from desired position when the roof panel is finally installed.

Figure 4:
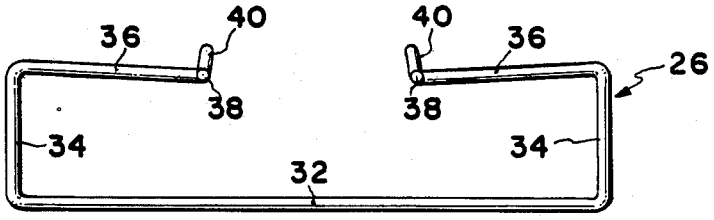
FIG. 4 is an end view of a board retaining clip.
Figure 2:
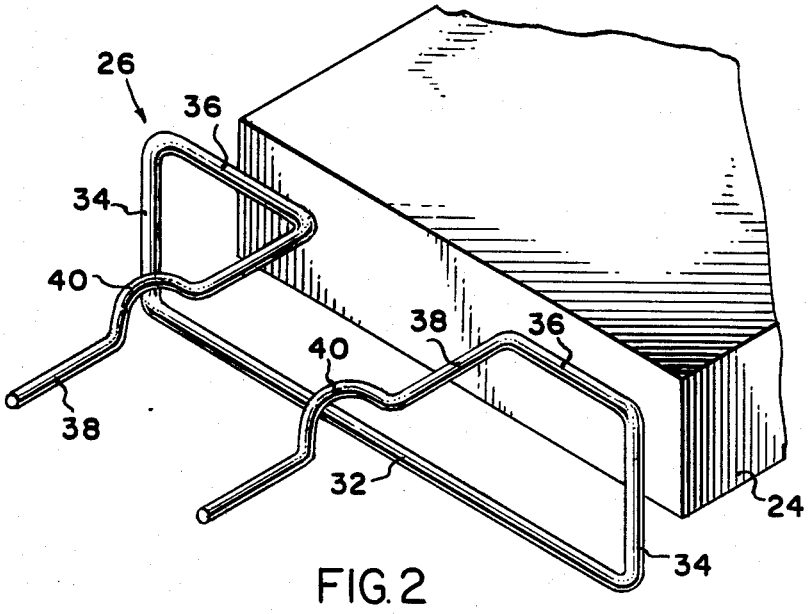
FIG. 2 is an exploded perspective view showing an insulation board retaining clip embodying the present invention and one end of an insulating board.

In order to maintain that end of each block 24 which will be completely concealed by the roof panel during installation against displacement during the panel installing process, a board retaining resilient clip 26, see particularly FIGS. 2 and 4, is provided, and two holes 28 (FIGS. 1 and 5) are formed in pressed out bell-shaped portions **30*a* of the vertical web 30 of panel mounting clip 12. As best seen in the perspective view of FIG. 2, each board retaining clip 26 is formed from a one-piece member of resilient stiff wire or rod-like material. The wire is formed into a retaining section which includes a lower run 32 bent upwardly at its opposite ends into side sections 34 which in turn are bent inwardly at their upper ends to form upper runs 36. The opposed upper runs 36 terminate short of each other and are bent at right-angles to form forwardly projecting arms 38, these latter arms 38 being formed with a stop "hump" portion as at 40 for assistance in locating the clip 26 relative to web 30 of a bracket. The spacing of retainer arms 38 is matched to that of the holes 28 in vertical web 30 of the panel mounting bracket 12, and the arms 38 are designed to project through the holes 28 provided in tubulated portions 30*a* of web 30 as indicated best in FIG. 5**.

Figure 3:
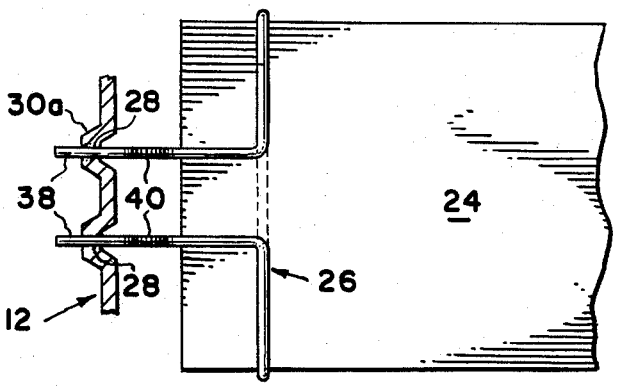
FIG. 3 is a top plan view, partially in section, showing an insulation board and board retaining clip in operative relationship with the roof panel mounting clip.

The retainer section defined by the lower run 32, side sections 34 and upper runs 36 is dimensioned to snugly receive the end of an insulating board 24, as best seen in FIGS. 1 and 3. Preferably, as indicated in FIG. 5, the upper runs 36 of the clip are normally sprung downwardly somewhat so that when the clip 26 is placed on an insulating board as in FIG. 3, the clip is deformed and resiliently grips the board to hold it firmly in position. The arms 36 may be sprung downwardly also to assist the upward pressure of the compressed insulation to bind arms 36 in openings 28 at lower and upper points **36*a* and 36*b* in a manner to prevent their displacement by forces applied in any direction except parallel to openings 28. At points 36*a* the wire arms 36 bite into the front edges of openings 28. To prevent longitudinal fracturing of boards 24 only one end of the board is anchored in place, but if clips 26 are made sufficiently resilient, conceivably a clip 26** could be used at both ends.

Referring now to FIG. 5 and proceeding with the installation of roof panels from left to right in the figure, as indicated at the right-hand side of this figure, a clip 26 is mounted upon the end of a board 24 and the two retainer arms 38 of the clip are retained within the openings 28 in the vertical web 30 of a bracket 12. This process is repeated at subsequent purlins over the entire distance which will be covered by the next to be installed roof panel (not shown). The next to be installed roof panel is then moved into position so that the new roof panel being installed (not shown) is in the same relationship to panel 14' of FIG. 5 as panel 14' is to the left-hand panel 14. This installation normally requires some longitudinal shifting of the roof panel being installed, after its edge E is received under the tabs T of the appropriate bracket attachment A, in order to get it accurately aligned longitudinally with the previously installed panel and this longitudinal shifting of the panel is normally done with the lower side of the roof panel which is to be installed resting on the insulating boards 24. The engagement between the board retaining clips 26 and their respective brackets prevents displacement of the boards 24 relative to their adjacent clips or brackets 12 during this process.

The next step in the roof assembly sequence finds clips or brackets 12 (not shown) being installed along the opposite, or as yet free edge (not shown), of the last installed roof panel (not shown), after which the individual clips or brackets 12 (not shown) are secured, by screws 20, to the underlying purlin 10 previously. This is the stage of the installation shown at the right-hand side of FIG. 5. During the seating of the individual clips or brackets 12, the configuration of the insulating board cross section 24 is such that the right-hand end of the board 24, as viewed in FIG. 5, is visible to and accessible to the installer who can adjust this end of the board if necessary just prior to seating the screws 20 which secure the adjacent clip bracket 12 in position. The configuration of the roof panels is such, as best shown at panel 14' of FIG. 5, that the flat central portion of each roof panel presses downwardly on the board 24 so that when the roof panel is finally installed, the board is firmly clamped between the roof panel and the top of insulating blanket 18.

While one example of a method and apparatus for practicing the present invention has been described in detail, it will be apparent to those skilled in the art that the method and apparatus may be modified. Therefore, the foregoing description is to be considered exemplary, rather than limiting, and the true scope of the invention is that defined in the following claims.

I claim:

1. In a standing seam roof construction including spaced apart elongate parallel purlins, a blanket of deformable, squeezable insulating material overlying said purlins, a roof panel supporting bracket above each purlin overlying said blanket and having a lower end fixedly supported by the purlins and an upper end for supporting roof panels, and an elongate standing seam roof panel supported at its one longitudinal side edge in mating relation with the longitudinal side edge of an adjacent roof panel by each bracket in overlying relationship with said blanket and with its longitudinal extent normal to that of said purlin; the improvement wherein said bracket includes a generally vertical web interjacent its ends extending transversely of said purlin and panel, having at least one clip receiving portion, a board-like unit of insulating material located between said panel and said blanket in overlying relationship to said purlin, and clip means embracing said one end of said unit, said clip means including projection means extending longitudinally beyond said one end of said board unit to secure to the clip receiving portion of said web to retain said one end of said unit against displacement relative to said purlin.

2. The invention defined in claim 1 wherein said clip means comprises a receiving section extending substantially entirely transversely around said board-like unit, and a retaining section projecting longitudinally from said receiving section beyond said one end of said unit through an opening in said web.

3. The invention defined in claim 1 wherein said clip means comprises a receiving section having a lower run section adapted to engage the bottom, side sections extending upwardly from said lower run along the opposed side edges of said board-like unit, and opposed upper runs extending from each side section transversely inwardly partially across the top of said unit, and a retainer arm projecting from each of said upper runs longitudinally of said board-like unit beyond said one end thereof, said web having two clip receiving openings respectively receiving the two retaining arms of said clip means.

4. The invention defined in either of claims 2 and 3 wherein said receiving section resiliently grips the board-like unit and the retaining arms are configured to bind in said openings.

5. The construction disclosed in claim 1 wherein the clip receiving portion of the web of the bracket includes an attaching part and the projection means is resiliently displaced from normal position to secure to said attaching part.

6. The construction disclosed in claim 1 wherein the clip receiving portion of the web of the bracket comprises a pair of spaced apart socket openings and said clip means has a pair of projections displaced from normal position to be resiliently retained in said socket openings.

7. The invention defined in claim 2 wherein the receiving section is resiliently displaced from normal configuration to grip the end of the isulation board unit.

8. For use in retaining one end of a board-like unit of insulating material against lateral displacement relative to a stationary roof support bracket web having a pair of horizontally spaced clip receiving openings therethrough; a one-piece clip of wire or rod-like material having a lower run adapted to extend transversely across the bottom of said board-like unit, a pair of side sections extending upwardly directly from the opposite ends of said lower run to provide a U-configuration in a transverse plane with the lower run and adapted to engage the side edges of said unit, opposed upper runs partially closing the U-configuration generally overlying the lower run and adapted to extend from the respective side sections partially transversely across the top of said unit, and a pair of parallel retainer arms extending generally normally to said plane in a direction away respectively from said upper runs and underlying lower run, and adapted to project through said clip receiving openings.

* * * * *